US009957749B2

(12) United States Patent
Frede

(10) Patent No.: US 9,957,749 B2
(45) Date of Patent: May 1, 2018

(54) SEALING DEVICE FOR SEALING A GAP BETWEEN A LINTEL AND A ROLLER SHUTTER AND A ROLLER SHUTTER WITH SUCH A SEALING DEVICE

(71) Applicant: ASSA ABLOY Entrance Systems AB, Landskrona (SE)

(72) Inventor: Friedhelm Frede, Erwitte (DE)

(73) Assignee: ASSA ABLOY ENTRANCE SYSTEMS AB, Landskrona (SE)

( * ) Notice: Subject to any disclaimer, the term of this patent is extended or adjusted under 35 U.S.C. 154(b) by 0 days. days.

(21) Appl. No.: 15/321,698

(22) PCT Filed: May 28, 2015

(86) PCT No.: PCT/EP2015/061862
§ 371 (c)(1),
(2) Date: Dec. 22, 2016

(87) PCT Pub. No.: WO2015/197303
PCT Pub. Date: Dec. 30, 2015

(65) Prior Publication Data

US 2017/0152705 A1 Jun. 1, 2017

(30) Foreign Application Priority Data

Jun. 26, 2014 (SE) ..... 1450790

(51) Int. Cl.
*E06B 9/00* (2006.01)
*E06B 9/17* (2006.01)
*E06B 9/15* (2006.01)

(52) U.S. Cl.
CPC ..... *E06B 9/17076* (2013.01); *E06B 9/15* (2013.01); *E06B 9/17* (2013.01);
(Continued)

(58) Field of Classification Search
CPC ..... E06B 9/17076; E06B 9/15; E06B 9/17; E06B 2009/1555; E06B 2009/17084
See application file for complete search history.

(56) References Cited

U.S. PATENT DOCUMENTS 983,104 A * 1/1911 Wilson ..... E06B 9/54 160/133
1,723,487 A * 8/1929 Ohno ..... E06B 9/15 160/133

(Continued)

FOREIGN PATENT DOCUMENTS

DE 4411147 A1 10/1995
DE 4426483 A1 * 11/1995 ..... E06B 9/17007

(Continued)

OTHER PUBLICATIONS

Machine translation of FR 2873153 (Sester); retrieved from https://worldwide.espacenet.com/publicationDetails/biblio?CC=FR&NR=2873153A1&KC=A1&FT=D&ND=3&date=20060120&DB=&locale=en_EP.*

(Continued)

*Primary Examiner* — Katherine W Mitchell
*Assistant Examiner* — Abe Massad
(74) *Attorney, Agent, or Firm* — Wissing Miller LLP

(57) ABSTRACT

The invention relates to a sealing device (11, 35, 41) for sealing a gap (32) between a lintel (30) and a roller shutter (10, 34, 40). The sealing device (11, 35, 41) has a sealing means (23) for arranging at the upper end of a top shutter element (24) of the roller shutter (10, 34, 40). For covering a gap (32) in a functional and/or cost-effective way between a lintel (30) and a roller shutter (10, 34, 40), preferably in case of a completely unrolled door blade (12), the sealing device (11, 35, 41) is characterized in that a swivel mechanism (25, 37, 43) is provided for swivelling the sealing
(Continued)

means (23) from a sealing position into a winding position and from a winding position into a sealing position.

20 Claims, 10 Drawing Sheets

(52) U.S. Cl.
CPC ..... *E06B 2009/1505* (2013.01); *E06B 2009/1555* (2013.01); *E06B 2009/17084* (2013.01)

(56) References Cited

U.S. PATENT DOCUMENTS 3,734,161 A * 5/1973 Pierce ..... E06B 9/08 160/133
4,356,856 A * 11/1982 Bengtsson ..... E06B 3/485 160/209
4,398,585 A * 8/1983 Marlow ..... E06B 9/17076 160/23.1
5,794,678 A * 8/1998 Beringer ..... E06B 9/42 160/268.1
6,883,577 B2 * 4/2005 Frede ..... E06B 9/56 160/133
2011/0030278 A1 * 2/2011 Breznikar ..... E06B 9/17076 49/358
2016/0348429 A1 * 12/2016 Frede ..... E06B 9/88

FOREIGN PATENT DOCUMENTS

DE 197 45 564 A1 6/1998
FR 2 873 153 A1 1/2006
WO WO 2013 167379 A1 11/2013

OTHER PUBLICATIONS

International Search Report and Written Opinion dated Aug. 26, 2015 in corresponding International Application No. PCT/EP2015/061862.
International-Type Search Report dated Jan. 28, 2015 in corresponding Sweden Priority Application No. 1450790-9.

* cited by examiner

SEALING DEVICE FOR SEALING A GAP BETWEEN A LINTEL AND A ROLLER SHUTTER AND A ROLLER SHUTTER WITH SUCH A SEALING DEVICE

CROSS-REFERENCE TO RELATED APPLICATIONS

This application is the National Stage entry under 35 U.S.C. § 371 of International Application No. PCT/EP2015/061862 filed on May 28, 2015, published on Dec. 30, 2015 under Publication Number WO 2015/197303, which claims the benefit of priority under 35 U.S.C. § 119 of Sweden Patent Application Number 1450790-9 filed Jun. 26, 2014.

BACKGROUND

Field

The invention relates to a sealing device for sealing a gap between a lintel and a roller shutter, the sealing device has a sealing means for arranging at the upper end of a top shutter element of the roller shutter. Furthermore, the invention relates to a roller shutter for opening and closing a doorway, the roller shutter has a door blade, the door blade comprises several rigid shutter elements which are hinged with each other, the shutter elements are guided by side rails at opposed sides of the doorway.

Description of Related Art

Such a sealing device is known from the introductory description of document WO 2009/109274 A1.

SUMMARY

Roller shutters like for example roller doors and/or industrial doors need to be sealed against wind and/or water. In case of a roller shutter there may be at least four areas which need to be sealed for closing a doorway by the shutter elements: The connections of adjacent shutter elements have to be sealed which may be done by hinge profiles, preferably rubber hinges. The contact area of the lower end of the undermost shutter element in regard to the floor has to be sealed which may be done by a flexible profile like for example a rubber profile with a deformable edge or lip. In the area of a side rail a gap between a slit of the side rail and the shutter elements need to be covered and sealed which may be done by a straight contour of the shutter elements, a minimal difference between the thickness of the shutter element and the width of the slit and/or by additional sealing profiles, preferably made of plastic or rubber. Finally a top sealing is needed between the door blade and a lintel and/or a lintel profile.

According to one known example mentioned in WO 2009/109274 A1 a lip or brush is fixed as a sealing device or sealing means on the top shutter element. This solution has the disadvantage that by rolling the door blade up the lip or brush is aligned between a first layer and a second layer of up rolled shutter elements. This limits the maximum length of the lip or brush in a way that typical gap sizes between a lintel and the top shutter elements may not be fully covered and/or closed sufficiently. Further drawbacks of this solution may be that the lip or brush is deformed and/or that the lip or brush touches at least one shutter element of an overlaying layer when the shutter elements are at least partly rolled up on each other. This may result in scratches and/or an intransparent area in case of a shutter element with a window element.

WO 2009/109274 A1 describes a swivelling flap fixed at the lintel. The drawback of this solution is the complexity of the construction and the additional installation effort.

Besides the roller shutter a separate sealing device has to be mounted at the lintel of a building opening.

A known alternative is to fix a brush and/or a rubber profile at the lintel. A drawback of this solution is that all shutter elements run along such a sealing device which may lead to undesirable scratches on the shutter elements.

Preferably the invention is related to roller shutters which are designed as rollup doors, more preferably as industrial high speed rollup doors. Roller shutters or rollup doors may be used in industrial facilities, such as factories, warehouses, garages, and the like to selectively cover doorways or guard machinery in order to provide security, as well as protection from debris and/or unwanted climatic variations.

It is a principal object of the present invention to enhance a sealing device and a roller shutter as mentioned in the preceding introduction such that the covering and/or sealing of a gap between a lintel and a roller shutter, preferably in case of a completely unrolled door blade, is realisable in a functional and/or cost-effective way. Preferably it is an object of the present invention to avoid additional noise during the operation of the roller shutter by the sealing device and/or to avoid any damages or wear to the shutter elements by the sealing device.

The object of the invention is accomplished by a roller shutter as mentioned in the preceding introduction, wherein a swivel mechanism is provided for swivelling the sealing means from a sealing position into a winding position and from a winding position into a sealing position.

As an advantageous result the swivel mechanism can be mounted directly to the roller shutter itself reducing the installation effort at the installation site for the roller shutter. Furthermore, the location of the sealing device and/or the swivel mechanism at the upper end of the top shutter element allows space-saving constructions.

Within the scope of this invention a roller shutter may be a high speed roller door. Preferably a roller shutter comprises several rigid shutter elements as slats, panels and/or lamellae. These shutter elements may form a door blade such that the door blade is moveable at least in a vertical direction for opening and closing the doorway. Preferably a directly or indirectly hinged connection of the shutter elements with each other allows the door blade to be rolled up on and/or unrolled of a coiling device of a roller shutter. Preferably a hinged connection of the shutter elements and/or end pieces of the shutter elements allow the transition of the door blade from the substantially vertical plane of the doorway into a substantially spiral arrangement, preferably by up rolling the door blade around a coiling device for opening a doorway, and vice versa for closing the doorway. Each shutter element may have two end sections and/or end pieces, wherein the two end sections and/or end pieces are arranged at two horizontally spaced ends of the shutter element respectively.

A lintel within the scope of this invention may be a door lintel, a window lintel and/or a lintel profile. The lintel profile may be mounted to a lintel, preferably a door lintel and/or a window lintel. Preferably the lintel profile is L-shaped and/or made of metal or plastic.

Furthermore and within the scope of this invention an outer side and/or an outward orientation, preferably of the roller shutter and/or its elements, may be at least substantially directed and/or facing away from the coiling device. An inner side and/or an inward orientation, preferably of the roller shutter and/or its elements, may be at least substantially directed and/or facing away from the outer side and/or towards the coiling device. Preferably an inner side and/or an inward orientation is assigned to the side of the roller shutter comprising the coiling device.

According to a further embodiment the swivel mechanism comprises a hinge and/or a flexible connection of the sealing device and/or sealing means with the upper end of the top shutter element. The hinged connection of the sealing device and/or means with the upper end of the top shutter element may have a swivel axis. The swivel axis is aligned substantially horizontally and/or parallel to a rotation axis and/or a rotatable shaft of a coiling device. Preferably the hinge is designed as a flexible rubber profile. The hinge may be made like a flexible sealing between adjacent shutter elements for sealing a horizontal gap between the shutter elements.

The sealing device comprises a sealing means. Preferably the sealing means extends in the sealing position towards the lintel and/or a lintel profile for sealing and/or covering a gap between the lintel and/or lintel profile on one side and the roller shutter and/or the top shutter element on the other side. The sealing means may extend transversely or perpendicular to the plane of the roller shutter and/or the top shutter element in the closed position of the roller shutter. Preferably the top shutter element is arranged within side rails of the roller shutter when the shutter elements are completely unrolled to close a doorway or the like. In case of a completely unrolled door blade the plane of the top shutter element may be aligned at least substantially vertical. More preferably the sealing means is a flexible sealing profile, a flexible sealing lip and/or a at least partly flexible sealing flap. Preferably the sealing means is a swivelling flap, which may be swivelling connected to the upper end of the top shutter element. The sealing means may have a tube-like cross section. A tube-like cross section increases the stability or resistance against twisting.

According to a further embodiment the swivel mechanism comprises a first swivel element for swivelling the sealing device and/or sealing means from the sealing position into the winding position. Preferably the first swivel element extends transversely or perpendicular to the plane of the roller shutter in the closed position of the roller shutter. The first swivel element may extend transversely or perpendicular to the, preferably at least substantially vertical, plane of the top shutter element in the sealing position. More preferably the first swivel element is a rigid arm, bar and/or projection. The first swivel element may be connected to the hinge. Thus, the first swivel element can be rotated about or around the swivel axis.

The first swivel element and the sealing means may be turned away from each other. Furthermore, the first swivel element and the sealing means may be arranged in substantially the same plane. In an alternative the planes of the first swivel element and the sealing means are aligned at least substantially parallel to each other. Preferably the sealing means is at least in the sealing position turned away from a coiling device for the shutter elements. The sealing means is directed towards the lintel in the sealing position. The first swivel element may be directed substantially towards the coiling device for the shutter elements in the sealing position and/or winding position. Preferably the sealing means is directed outwards and/or the first swivel element is directed inwards in the sealing position.

According to a further embodiment the swivel mechanism comprises a further swivel element. The further swivel element may be arranged or mounted at a coiling device for coiling the shutter elements. The further swivel element may be provided for cooperating with the first swivel element to swivel the sealing means from the sealing position in the winding position. Preferably the further swivel element is fixed or mounted to the coiling device in the area of a smallest radius of the coiling device. The further swivel element may be fixed or mounted to a disk of the coiling device, preferably to an inner side of the disk oriented towards an opposing end of the coiling device. More preferably the further swivel element is designed as a guiding profile for guiding the first swivel element in the winding position and/or for holding the first swivel element in the winding position. Preferably the first swivel element and/or the further swivel element is made of or comprises a low friction, dampening and/or wear-resistant material and/or plastic.

A centre of gravity of the sealing device and/or the sealing means may be located outside the swivel axis of the swivel mechanism. Preferably the centre of gravity is located spaced apart from a hinge and/or a flexible connection of the sealing means with the upper end of the top shutter element. The centre of gravity may be located in the area of a sealing means for allowing the sealing means to swivel from the winding position into the sealing position under the effect of gravity. Thus, no additional elements are needed to force the sealing device and/or the sealing means from the winding position into the sealing position. By arranging the gravity centre of the sealing device, the swivelling mechanism and/or the sealing means outside the hinge, the sealing means can fall into the sealing position by its own weight when the shutter elements, preferably the top shutter element, are unrolled.

According to a further embodiment the swivelling mechanism comprises at least one actuating element for forcing the swivelling of the sealing device and/or a sealing means from the winding position into the sealing position. For compensating friction in the hinge and/or for increasing wind resistance it is advantageous to force, pull or push the sealing device and/or sealing means from the winding position into the sealing position by the actuating element. Furthermore, the actuating element may reliably hold the sealing device and/or sealing means in the sealing position. Preferably the actuating element acts on the sealing device, the sealing means and/or a first swivel element outside and/or displaced to a swivel axis. The actuating element may be and/or comprise a spring and/or a flexible element. The spring may be a tension spring for pulling the sealing device and/or sealing means into the sealing position or a compression spring for pushing the sealing device and/or sealing means into the sealing position. Preferably the flexible element is a cable, a rod and/or a cord. The flexible element may be made of elastic rubber. The actuating element may be blocked when the first swivel element is in contact and/or in cooperation with the further swivel element. The actuating element may force the sealing device and/or sealing means into the sealing position only when the first swivel element is not in contact and/or in cooperation with the further swivel element.

According to another embodiment of the present invention a roller shutter for opening and closing a doorway is provided. The roller shutter has a door blade and the door blade comprises several rigid shutter elements which are hinged with each other. The shutter elements are guided by side rails at opposed sides of the doorway. Such a roller shutter has a sealing device according to present invention. Preferably the roller shutter is a high speed roller door. The shutter elements may be foamed lamellae. Preferably the shutter elements can up roll on and/or unroll of a disk system of a coiling device. More preferably the shutter elements of a first layer are not directly up rolled on the coiling device. There may be a need for space between the coiling device and at least the top shutter element in a rolled up position. This may be achieved by rolling up the shutter elements at least of the first layer on coiling means. These coiling means may be disks, preferably spiral disks. Preferably the top shutter element is unrolled from the coiling device and/or the spiral discs in the sealing position of the sealing device. More preferably the top shutter element is unrolled from the coiling device and/or the spiral discs in the completely closed position of the door blade to fully close the doorway.

Preferably the door blade is in a completely unrolled position when the sealing device and/or sealing means is in the sealing position. More preferably the door blade is in a completely unrolled position when the top shutter element is arranged within the side rails and/or the plane of the top shutter element is at least substantially aligned vertically. Preferably the door blade is in an at least partly up rolled position when the sealing device and/or sealing means is in the winding position. Preferably the sealing device and/or sealing means is in the winding position when the top shutter element is coiled on the coiling device. The top shutter element may be in an up rolled position arranged on a top roll barrel and/or the coiling device when the sealing device and/or sealing means is in the winding position.

According to a further embodiment a sealing means and/or a first swivel element extends transversely or perpendicularly to the plane of the door blade and/or to the plane of the top shutter element in the closed position of the door blade. The sealing means protrudes in the sealing position over the top shutter element towards the lintel. Preferably a free end of the sealing means contacts, abuts and/or lays on the lintel when the sealing device and/or sealing means is in the sealing position. Preferably the sealing means and/or the first swivel element extends substantially in line and/or parallel to the plane of the top shutter element in an up rolled position of the top shutter element.

The sealing device may be designed as a retrofit kit. Thus, existing roller shutters can easily be retrofit with the sealing device. Preferably the swivelling mechanism, a first swivel element, a further swivel element and/or an actuating element is arranged on the right hand side and/or left hand side of the roller shutter, the top shutter element and/or the coiling device. At least a double implementation of the swivel mechanism provides a redundant system.

Preferably the shutter elements are guided within a slit of the side rails. Each side rail has a slit extending substantially vertically. The slits of both side rails are facing towards each other. The ends of the shutter elements, which are aligned in an at least substantially horizontal orientation, are extending through the slit into an interior space of the hollow side rails. The side rails may form a side frame guiding for guiding the shutter elements and/or the door blade in the area of the doorway and/or a vertical plane of the doorway. Preferably end sections and/or end pieces of the shutter elements are at least substantially arranged and/or located inside the hollow side rails for opening and/or closing the doorway. At least one carrying strap may be connected with the end pieces and/or the coiling device to roll up and roll down the shutter elements. Thus, the end pieces and the carrying strap are arranged within the hollow side rails providing an aesthetical view and protection against damage and/or pollution. The carrying strap serves as a lifting device or lifting element. The carrying strap may be a belt. The carrying strap and/or the belt may be flat and/or flexible to be wound and unwound in regard to a coiling device. In an alternative embodiment more than one carrying strap may be provided. In case of two, three or more carrying straps the carrying straps may be aligned parallel to each other.

Preferably two opposed ends of the shutter elements are guided within a slit of the side rails. The width of the slit may be such that the shutter element is guided substantially frictionless within the vertical slit but at the same time the width of the slit may be as small as possible. The width of the slit may be only slightly thicker than the thickness of the shutter element and/or an end of the shutter element with a recess of an end piece encompassing the end of the shutter element. In case of a wind load acting on a closed door blade the ends of the shutter elements interact with the side rail avoiding any critical force, bending moment and/or torque on the end pieces and/or the carrying strap inside the hollow side rail. Preferably the width of the slit increases in the top area of the side rail for creating a funnel. The funnel may have an increasing opening towards the upper end of the side rail. The two opposing vertical edges of the side rail forming the slit may comprise plastic bars. Thus, the arrangement of the slit in the side rail allows a transition from the side rail to the coiling device and vice versa as well as a guidance of the shutter elements within the side rail.

According to a further embodiment the coiling device comprises two pairs of spiral discs, whereby one pair of spiral discs is arranged at each end of a rotatable shaft facing away from each other. The rotatable shaft is rested stationary such that a rotation around the longitudinal axis is possible but no movement of the shaft in a vertical and/or horizontal direction. Preferably a pair of spiral discs is arranged for receiving end sections and/or end pieces of the shutter elements rolled up on the coiling device. More preferably the spiral discs of each pair have a distance to each other in the longitudinal direction of the shaft for receiving the end section and/or the end piece between the spiral discs.

The shutter elements may be formed as slats, lamellae and/or panels which are connected with each other by a flexible hinge, a flexible joint and/or a flexible carrying strap for rolling up and unrolling the door blade on and off a coiling device. Preferably the shutter elements are foamed lamellae and/or insulated foamed sandwich panels. The foamed core may be enclosed by a sandwich sheet wall. The shutter elements may be elongated and/or oriented substantially in a horizontal direction. Preferably horizontal edges of adjacent shutter elements are configured to at least partially engage with each other in a horizontally pivoting fashion. The shutter elements may have window-like openings extending there through, by way of example for ventilation and/or visibility. The openings may be covered with transparent or translucent materials to limit ventilation and/or visibility. The shutter elements, more preferably an outer shell, may be fabricated from rigid materials such as metal and/or plastic.

The roller shutter may be a high speed roller door. Preferably the door blade of the high speed roller door is moved in normal operation with a maximum speed in the range of 0.5 m/s to 5 m/s. More preferably is a maximum speed in normal operation in the range of 1 m/s to 3 m/s, particularly a speed of about 2 m/s.

In regard to high speed roller doors the topic energy saving becomes more and more important. To optimize the thermal insulation the thickness and/or height of the shutter elements may be increased. Common high speed roller doors may have a maximum lamella thickness of approximately 20 mm and/or a lamella height in the range between 125 mm and 150 mm. Preferably the shutter elements according to the present invention have a height of more than 150 mm. The shutter elements may be insulated foamed sandwich panels with end pieces at their ends facing horizontally away from each other.

A sealing device according to the present invention and a roller shutter with such a sealing device provides a sufficient top sealing of a roller shutter and/or a top shutter element against a lintel and/or lintel profile. The sealing device may be reliable and in operation for long period of time. Preferably the sealing device and/or the sealing means do not touch, contact or abut the surface of the shutter elements. Thus, the sealing device according to the present invention avoids scratches on the surface of the shutter elements. It is advantageous that the sealing device does not produce additional and/or noticeable noise. Preferably the sealing device enables a soft operation. The wear of the sealing device and its components may be reduced to a minimum. There may be no critical wear on the sealing device and/or the mechanical parts of the swivel mechanism at all. Preferably the sealing device is suitable to retrofit roller shutters. The sealing device may be produced and/or installed at low costs and is effective in operation. Even in worst case when the sealing means remains in the sealing position the roller shutter may be still operable. In such a case a preferably flexible sealing means will be bended and/or rolled in between a first layer and a second layer of up rolled shutter elements.

BRIEF DESCRIPTION OF THE DRAWINGS

The following detailed description, given by way of example and not intended to limit the present invention solely thereto, will best be appreciated in conjunction with the accompanying figures, wherein like reference numerals denote like elements and parts, in which.

DETAILED DESCRIPTION

The present invention will now be described more fully hereinafter with reference to the accompanying figures in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

The roller shutter will be described as a high speed roller door selectively blocking or opening a doorway. This recitation is for convenience only. It would be understood by one skilled in the art that such a roller door or rollup door is suitable for many embodiments and/or applications, including but not limited to industrial high speed rollup doors, interior doorway covering, exterior doorway covering, etc.

Figure 1:
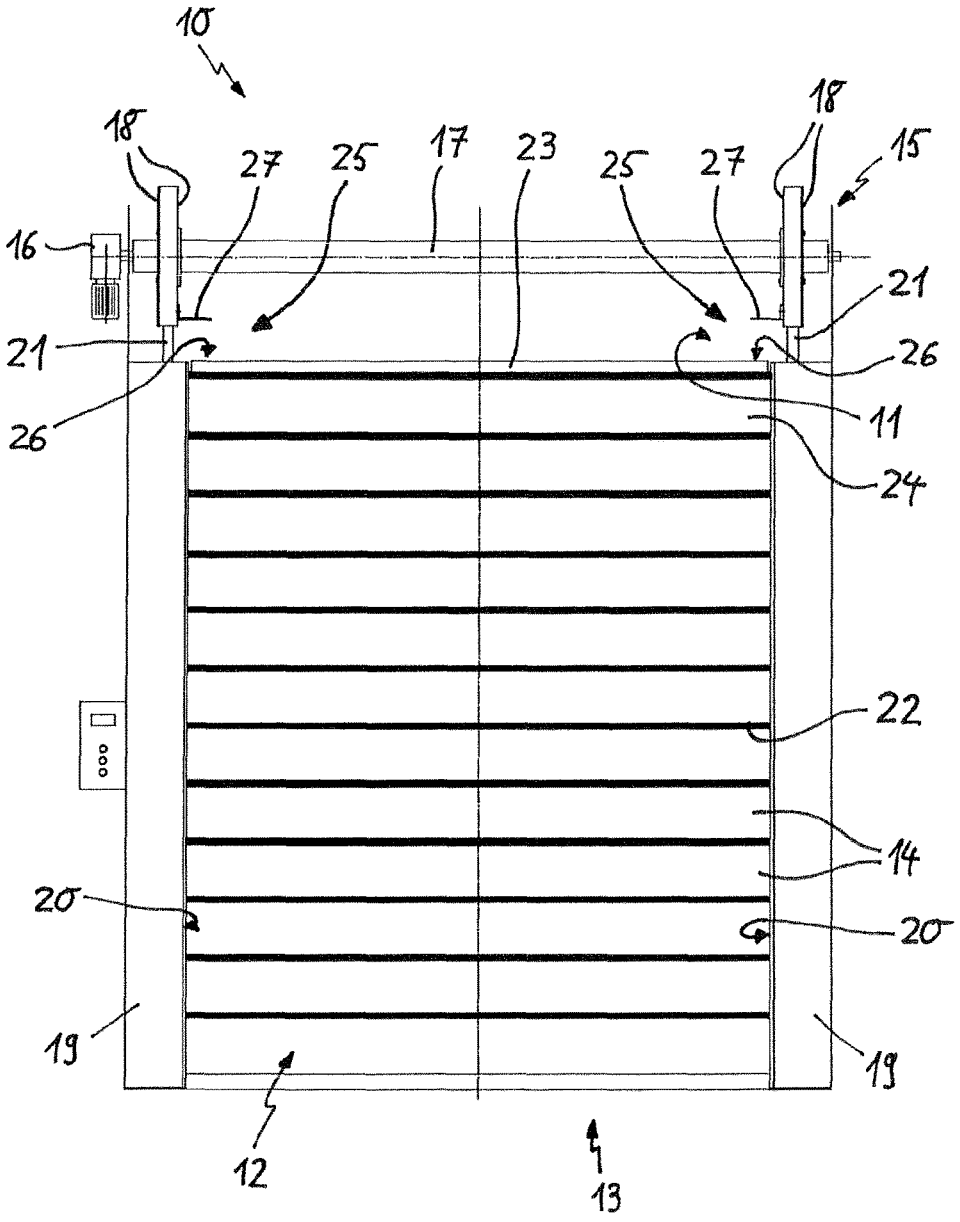
FIG. 1 is a schematic front view of a roller shutter having a sealing device according to the present invention.

FIG. 1 shows a schematic front view of a roller shutter 10 having a sealing device 11 according to the present invention. The roller shutter 10 has a door leaf or door blade 12. According to this figure the door blade 12 is shown in a completely unrolled position for closing a doorway 13. The door blade 12 comprises several shutter elements 14.

For greater clarity not all shutter elements 14 provide a reference numeral. In this embodiment the shutter elements 14 are rigid and foamed lamellae 14. Thus, the lamellae 14 comprise a foamed core. The lamellae 14 are at least partly rotatable coupled to each other allowing up and unrolling of the lamellae 14 around a coiling device 15.

A drive 16 provides a rotational force or torque to a rotatable shaft 17 of the coiling device 15 to raise or up roll the door blade 12 by rotating the coiling device 15 and the shaft 17 in a first direction and to lower or unroll the door blade 12 by rotating the coiling device 15 and the shaft 17 in a second direction opposite to the first direction.

The rotatable shaft 17 is part of the coiling device 15. According to this embodiment the coiling device 15 comprises four spiral discs 18. A pair of two spiral discs 18 is fixed to each end of the rotatable shaft 17. The rotatable shaft 17 is aligned in a horizontal direction.

The roller shutter 10 further comprises two side rails 19. The side rails 19 elongate or extend in a vertical direction and are designed to receive end pieces 20 of the lamellae 14 within the hollow side rails 19.

The side rails 19, provided on both sides of the doorway 13, define the width of the passable doorway 13 and are configured to accept and guide an end section 20 of the lamellae 14 within a slot or slit. In this embodiment the end section 20 is designed as an end piece 20 fixed to the ends of each lamellae 14. Each lamella 14 provides two end pieces 20, one end piece 20 at each lamella end. Both ends of each lamellae 14 are aligned in a horizontal direction and turned away from each other. The lamellae 14 elongate in a horizontal direction.

The lamellae 14 are connected pivotable with each other by a flexible carrying strap 21 connected to the end pieces 20. Between adjacent pivotable connected lamellae 14 a horizontal seal 22 is provided avoiding the entry of moisture and/or dirt. The horizontal seal 22 is flexible and in this embodiment the horizontal seal 22 is made of an elastomer, preferably EPDM (Ethylene Eropylene Diene Monomer) or TPE (Thermo Plastic Elastomer). For greater clarity not all horizontal seals 22 connecting adjacent lamellae 14 with each other provide a reference numeral.

A carrying strap 21 is fixed at each side of the coiling device 15. In this embodiment the upper ends of both carrying straps 21 are fixed between the spiral discs 18 of a pair at each side of the coiling device 15 respectively. The carrying strap 21 is connected with the end pieces 20 to roll up and roll down the lamellae 14. The flexible carrying strap 21 realizes a flexible and/or hinged connection. One carrying strap 21 is provided on each side of the doorway 13 in conjunction with the end pieces 20 assigned to the side rails 19 at each side of the roller shutter 10. In one rotating direction of the coiling device 15 the carrying strap 21 with end pieces 20 will be hoisted and rolled up, causing the lamellae 14 to be wound up around the coiling device 15, opening the doorway 13. In a second rotating direction of the coiling device 15 turned away from the first direction the carrying strap 21 with the end pieces 20 will unwind from its rolled up position, releasing the lamellae 14 to cover the doorway 13. The sections of the carrying straps 21 connected with unrolled end pieces 20 are arranged within or inside the hollow side rails 19.

Each spiral disc 18 may comprise a damping profile on its outer circumference leading to a reduction of noise when lamellae 14 or end pieces 20 are rolled on or rolled up the spiral discs 18. In this embodiment the damping profiles are made of rubber leading to an anti-slip function which avoids movement of up rolled end pieces 20. Furthermore, the wear of a contacting face of end piece 20 is reduced.

The sealing device 11 comprises a sealing means 23. The sealing means 23 is arranged to the upper end of a top shutter element 24. The top shutter element 24 is in this embodiment the topmost lamella 24 of the door blade 12 when the door blade is completely unrolled to close the doorway 13. The sealing means 23 extends substantially over the whole horizontal extent of the top lamella 24. In this embodiment the sealing means 23 is designed as a flexible sealing flap made of plastic.

The sealing device 11 has a swivel mechanism 25 for swivelling the sealing means 23 from a sealing position as shown in FIG. 1 into a winding position and vice versa. In this embodiment the sealing device 11 has a first swivel mechanism 25 on the left hand side of the roller shutter 10 and a second swivel mechanism 25 on the right hand side of the roller shutter 10. In an alternative embodiment only a single swivel mechanism 25 or more than two swivel mechanism 25 may be provided.

The swivel mechanism 25 comprises a first swivel element 26 and a further swivel element 27. The first swivel element 26 is assigned to the sealing means 23 and is designed to cooperate with the further swivel element 27 to guide the sealing device 11 and the sealing means 23 into the winding position. The further swivel element 27 is according to this embodiment fixed at a side of an inner spiral disc 18, whereby the further swivel element 27 extends perpendicular from the side plane of the spiral disc 18 in a direction towards the spiral discs 18 of the other side of the roller shutter 10. In this embodiment the further swivel element 27 is made as a rigid L-shaped bracket.

Figure 2:
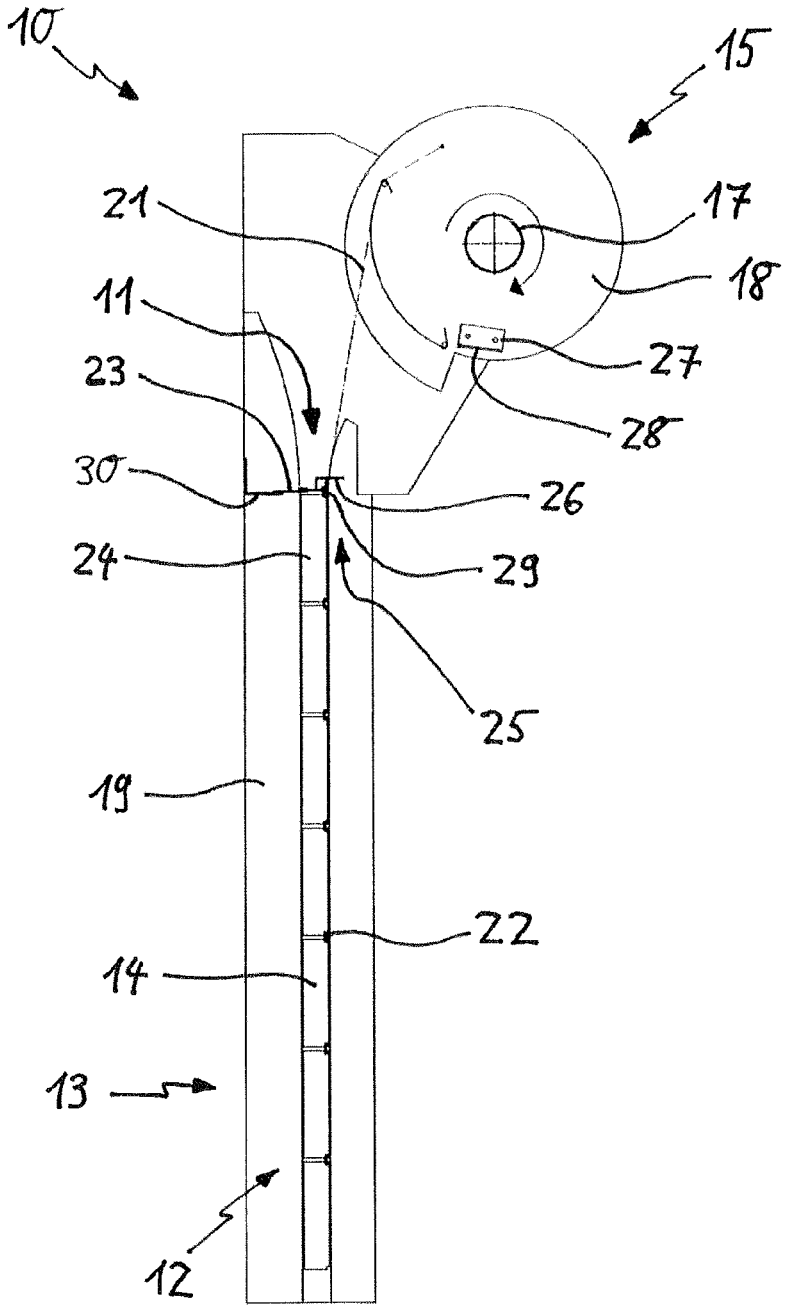
FIG. 2 is a schematic cross sectional side view of the roller shutter according to FIG. 1 with the sealing device in a sealing position.

FIG. 2 is a schematic cross sectional side view of the roller shutter 10 according to FIG. 1 with the sealing device 11 in a sealing position.

In this embodiment an inner side of the roller shutter 10 or door blade 12 is at least partly directed or faced towards the coiling device 15. The rotatable shaft 17 of the coiling device 15 is displaced out of the plane of the closed door blade 12. According to this exemplary embodiment the distance of the shaft 17 to the plane of the closed door blade 12 corresponds substantially to the maximum radius of the spiral disc 18. An outer side of the roller shutter 10 or the door blade 12 is facing away from the inner side and the coiling device 15.

This cross sectional side view shows only one inner spiral disc 18 of a pair of spiral discs 18. It is indicated that the upper end of the carrying strap 21 is mounted to the spiral discs 18. The spiral discs 18 have a continuously increasing radius such that an outer circumference of the spiral discs 18 comprises a mismatch. The smallest radius merge smoothly to the greatest radius over a rotation of approximately 360 degrees. Furthermore, the two spiral discs 18 of each pair are arranged as mirror images of each other.

According to this embodiment the greatest radius of the spiral discs 18 exceeds the smallest radius of the spiral discs 18 by a dimension at least substantially equal to the thickness of end pieces 20 or thickness of the lamellae 14, 24 plus the distance of two layers of lamellae 14 rolled up on each other.

The further swivel element 27 is fixed to the inner side of the inner spiral disc 18 in the area of the smallest radius. A surface 28 of the further swivel element 27 extending perpendicular out of the inner side of the spiral disc 18 is oriented substantially parallel to the outer circumference of the spiral disc 18.

The swivel mechanism 25 comprises a hinge 29. The hinge 29 is fixed to the upper end or upper side of the top lamella 24. In this embodiment the hinge 29 is designed as a flexible rubber profile. The hinge 29 may be identical with the seal 22.

The sealing means 23 is connected with the hinge 29. In the sealing position of the sealing device 11 the sealing means 23 extends towards a lintel or lintel profile 30. In this embodiment the L-shaped lintel profile 30 is fixed to a lintel of the doorway 13.

Figure 3:
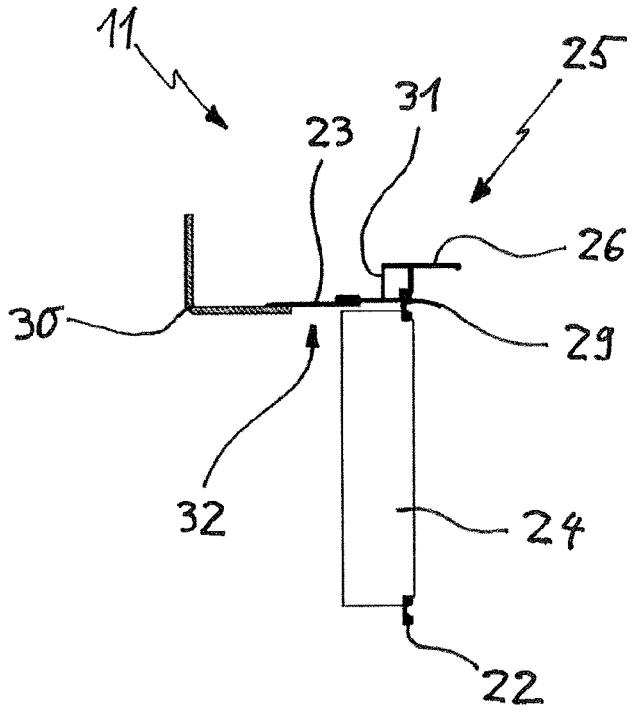
FIG. 3 is a schematic cross sectional view of a detail of the roller shutter according to FIG. 2.

FIG. 3 is a schematic cross sectional view of a detail of the roller shutter 10 according to FIG. 2. In this embodiment the sealing device 11 has a base profile 31. This base profile 31 has a tube-like cross section to increase stability against twisting. The base profile 31 is flexible connected by the hinge 29 to the upper end of the top lamella 24.

The sealing means 23 is fixed to the base profile 31 and seals in the sealing position a gap 32 between the lintel profile 30 and the top lamella 24. The first swivel element 26 is a rigid arm and fixed to base profile 31. In this embodiment the first swivel element 26 and the sealing means 23 extends in the sealing position of the sealing device 11 perpendicular to a plane of the top shutter element 24 and the closed door blade 12. The sealing means 23 and the first swivel element 26 are directed away from each other. In the sealing position of the sealing device 11 the sealing means 23 is directed away from the coiling device 15 whereas the first swivel element 26 is at least substantially directed towards the coiling device 15.

Figure 4:
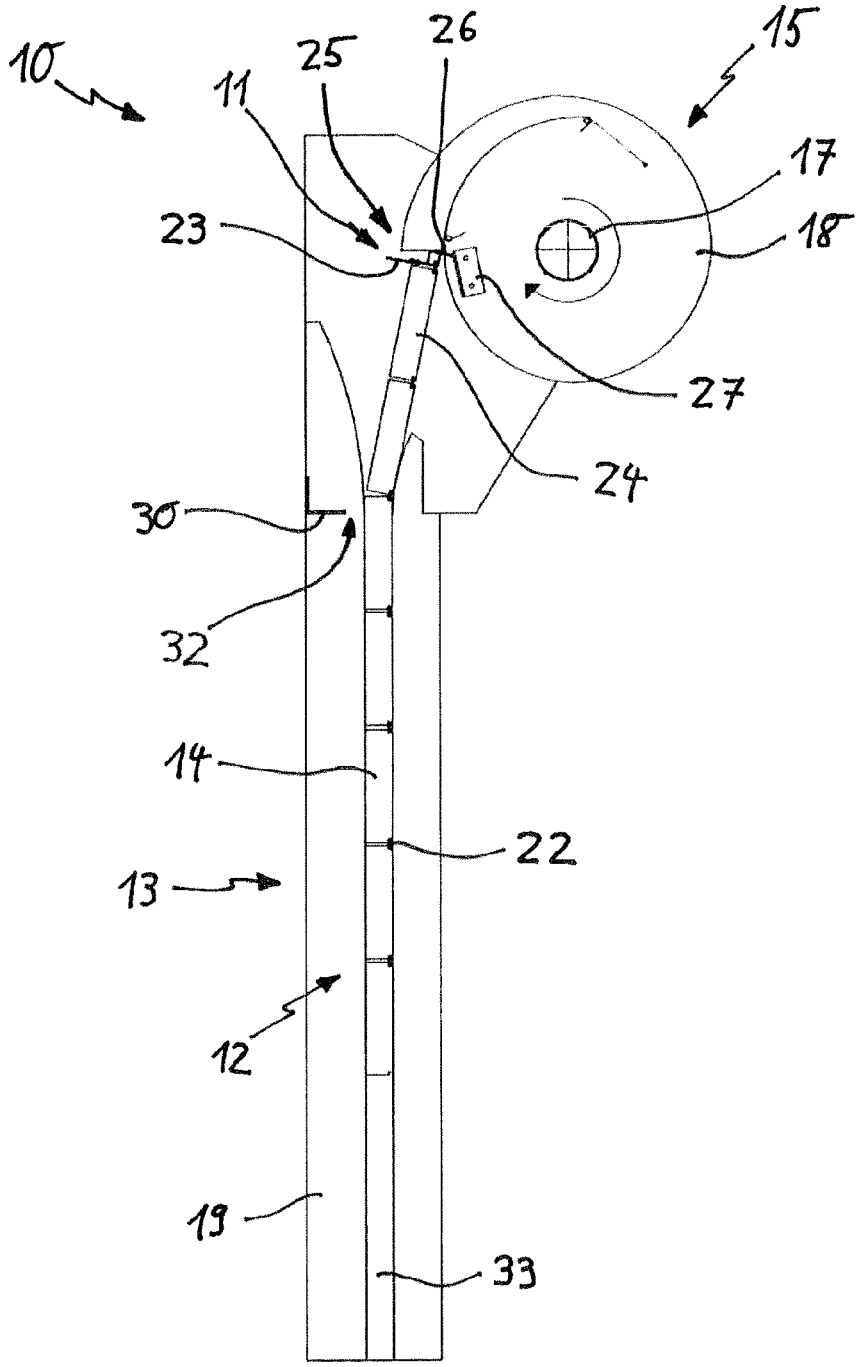
FIG. 4 is a schematic cross sectional side view of the roller shutter with a slightly up rolled door blade.

FIG. 4 is a schematic cross sectional side view of the roller shutter 10 with a slightly up rolled door blade 12. The top lamella 24 is arranged in an area between the top end of the side rails 19 and the coiling device 15. The top lamella 24 is positioned directly next to the coiling device 15, but without being rolled up on the spiral discs 18. In this intermediate position of the top lamella 24 is the sealing device 11 and the sealing means 23 still in the sealing position, but caused by the partly lifting of door blade 12 the gap 32 is not sealed anymore by the sealing means 23. An outer free end of the first swivel element 26 is just contacting the further swivel element 27.

Figure 5:
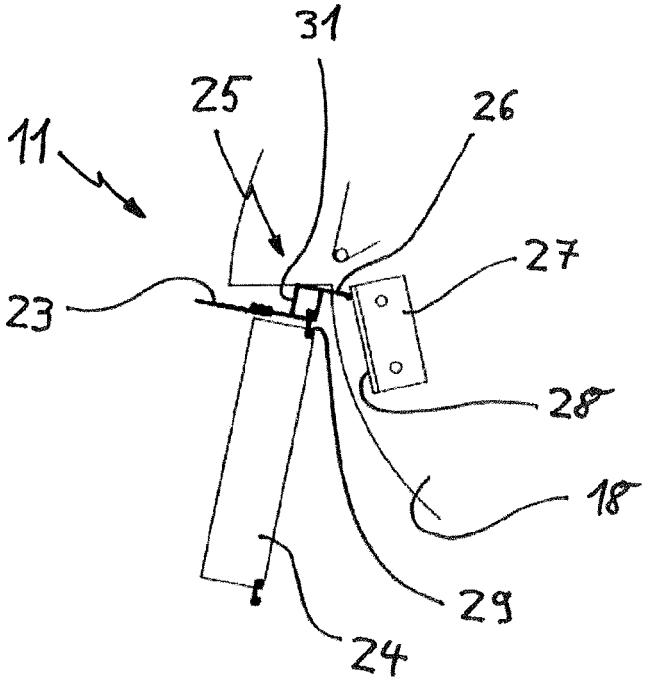
FIG. 5 is a schematic cross sectional view of a detail of the roller shutter according to FIG. 4.

FIG. 5 is a schematic cross sectional view of a detail of the roller shutter 10 according to FIG. 4. A free end of the first swivel element 26 abuts the surface 28 of the further swivel element 27. In an upward oriented direction for up rolling the door blade 12 the surface 28 is arranged in an acute angle to the first swivel element 26. The arrangement of the first swivel element 26 and the further swivel element 27 ensures that the first swivel element 26 and the sealing means 23 will rotate around the swivel axis of the hinge 29 such that the first swivel element 26 is moved towards the top lamella 24 and the sealing means 23 is moved away from the upper end of the top lamella 24. The swivel axis of the hinge 29 is oriented parallel to the upper end of the top lamella 24. In this embodiment the swivel axis of the hinge 29 is at least substantially aligned horizontally and parallel to rotatable shaft 17.

When opening a fully closed doorway 13 by up rolling the door blade 12 the top lamella 24 comes nearer and nearer to the spiral discs 18 until the first swivel element 26 contacts the further swivel element 27 as shown in FIGS. 4 and 5. The free end of the first swivel element 26 hits the surface 28 of the further swivel element 27 and during the further roll up of the door blade 12 and the top lamella 24 the first swivel element 26 is pressed towards a face of the top lamella 24 by the further swivel element 27. Thus, the sealing means 23 swings around the swivel axis of hinge 29 and the free end of the first swivel element 26 slides along the surface 28 of the further swivel element 27 for entering the winding position as shown in following FIGS. 6 and 7.

Figure 6:
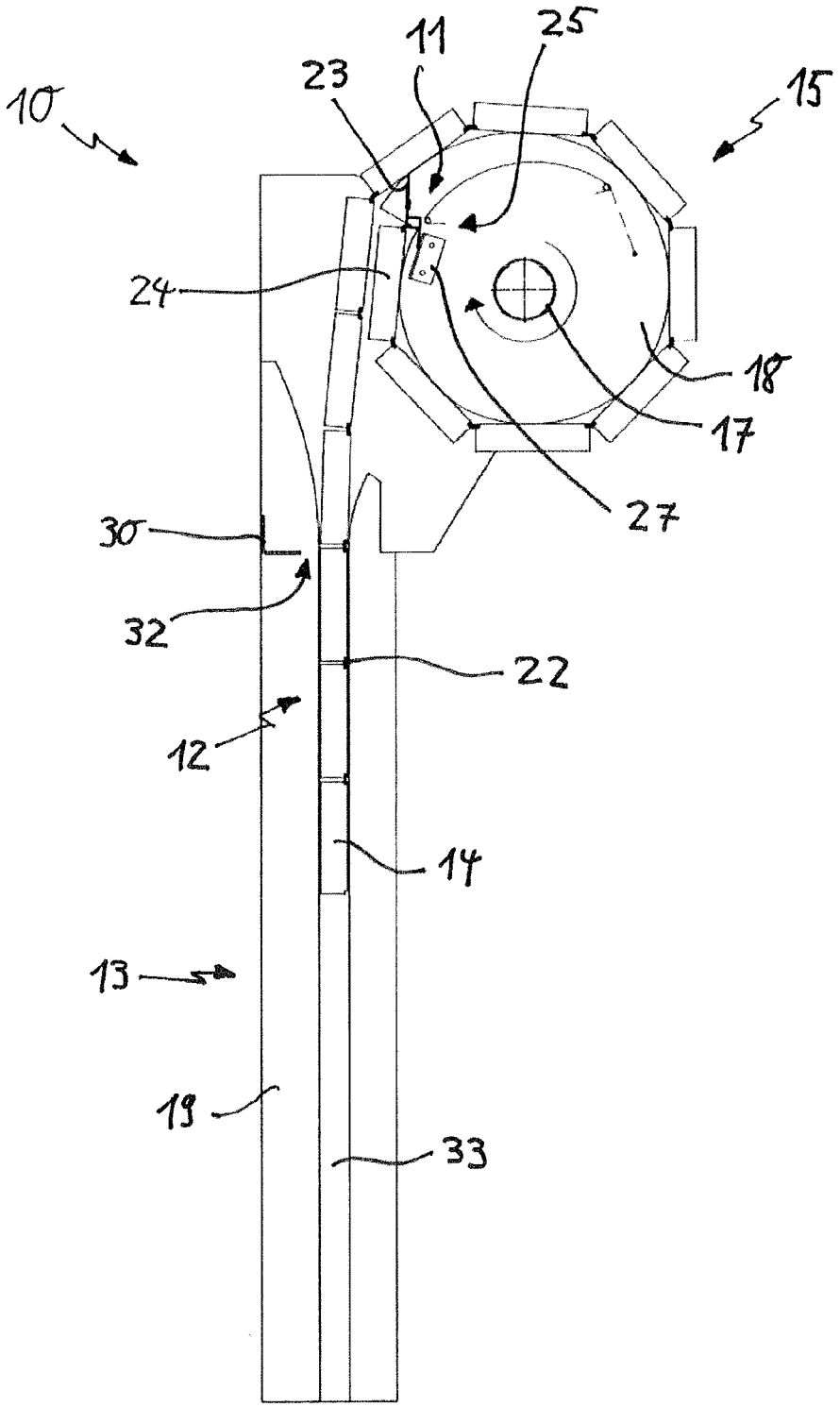
FIG. 6 is a schematic cross sectional side view of the roller shutter with a partly up rolled door blade and the sealing device in a winding position.

FIG. 6 is a schematic cross sectional side view of the roller shutter 10 with a partly up rolled door blade 12 and the sealing device 11 in a winding position. The upper lamellae 14 establish a first layer of lamellae 14 or end pieces 20 on the outer circumference of the coiling device 15. The doorway 13 is partly closed or opened and the lamellae 14, guided by a slit 33 in the side rail 19, run into or out of the side rail 19.

In case the door blade 12 would be rolled up the outer radius of the coiling device 15 with the layers of lamellae 14 or end pieces 20 would increase. Thus, the lamellae 14 will start running over and/or along an outer radius of an opening at an upper end of the side rail 19. The face of the outer radius of the opening of the side rail 19 is substantially directed towards the coiling device 15. The outer radius is assigned to an outer side of the side rail 19. Furthermore, the upper end of the side rail 19 is in the area of the outer radius or the lintel profile 30 higher than the upper end of the side rail 19 turned away from the lintel profile 30. In case the door blade 12 would be unrolled the outer radius of the coiling device 15 with the layers of lamellae 14 or end pieces 20 would decrease.

A first layer of lamellae 14 or end pieces 20 arranged on a pair of spiral discs 18 follows a smooth curve or radius as preset by the outer circumference of the spiral discs 18. If the door blade 12 is further rolled up on the coiling device 15, each successive layer of lamellae 14 or end pieces 20 will lie smoothly on top of the underlying layer of lamellae 14 or end pieces 20.

The cross sections of end pieces 20 may be chosen to substantially correspond to the outer circumference of the spiral discs 18 and/or of the layers of up rolled end pieces 20 respectively. This allows successive layers of end pieces 20 wound onto or around the spiral discs 18 and onto preceding layers of end pieces 20 to present a smooth wound outer surface and a compact rolled up door blade 12. In this regard a geometric relationship has to be considered which combines the height of the doorway, the configuration of the spiral discs 18 and the height as well as the cross section of the end pieces 20. Each layer of rolled up end pieces 20 creates a greater diameter or radius of the coiling device 15 for successive layers to wind up onto. This may result in deviating cross sections, convex sections and/or concave sections for each end piece 20 in a row as fixed to the carrying strap 21. Preferably a fully wound up door will require partial and/or full 360 degree revolutions, more preferably one, two, three or more 360 degrees turns, of the shaft 17 depending on the height of the door blade 12 and/or doorway 13.

Figure 7:
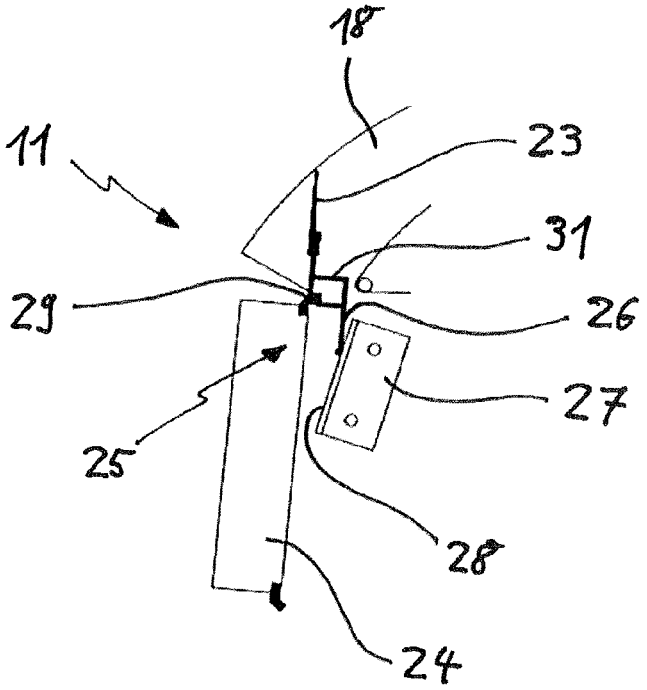
FIG. 7 is a schematic cross section sectional view of a detail of the roller shutter according to FIG. 6.

FIG. 7 is a schematic cross section sectional view of a detail of the roller shutter 10 according to FIG. 6. The further swivel element 27 forces the first swivel element 26 in the winding position. In comparison with the sealing position in accordance with FIGS. 1 to 4 the sealing device 11 or the sealing means 23 is swivelled into the winding position with a turn of about 90 degree around the swivel axis of hinge 29.

The sealing means 23 and the first swivel element 26 are aligned at least substantially parallel to the plane of the top lamella 24. In the winding position of the sealing device 11 the sealing means 23 is directed towards an area of the spiral discs 18 with a radius identical or nearly identical to the maximum radius of the spirals disc 18. The size or dimension of the sealing means 23 is such that the sealing means 23 does not protrude over the outer circumference of the spiral disc 18. This prevents any contact of the sealing means 23 to a lamella 14 of an overlying layer of up rolled lamellae 14.

In the winding position of the sealing device 11 the further swivel element 27 holds the first swivel element 26 reliably in the winding position, thereby forcing and holding the base profile 31 and the sealing means 23 in their winding positions as well.

Figure 8:
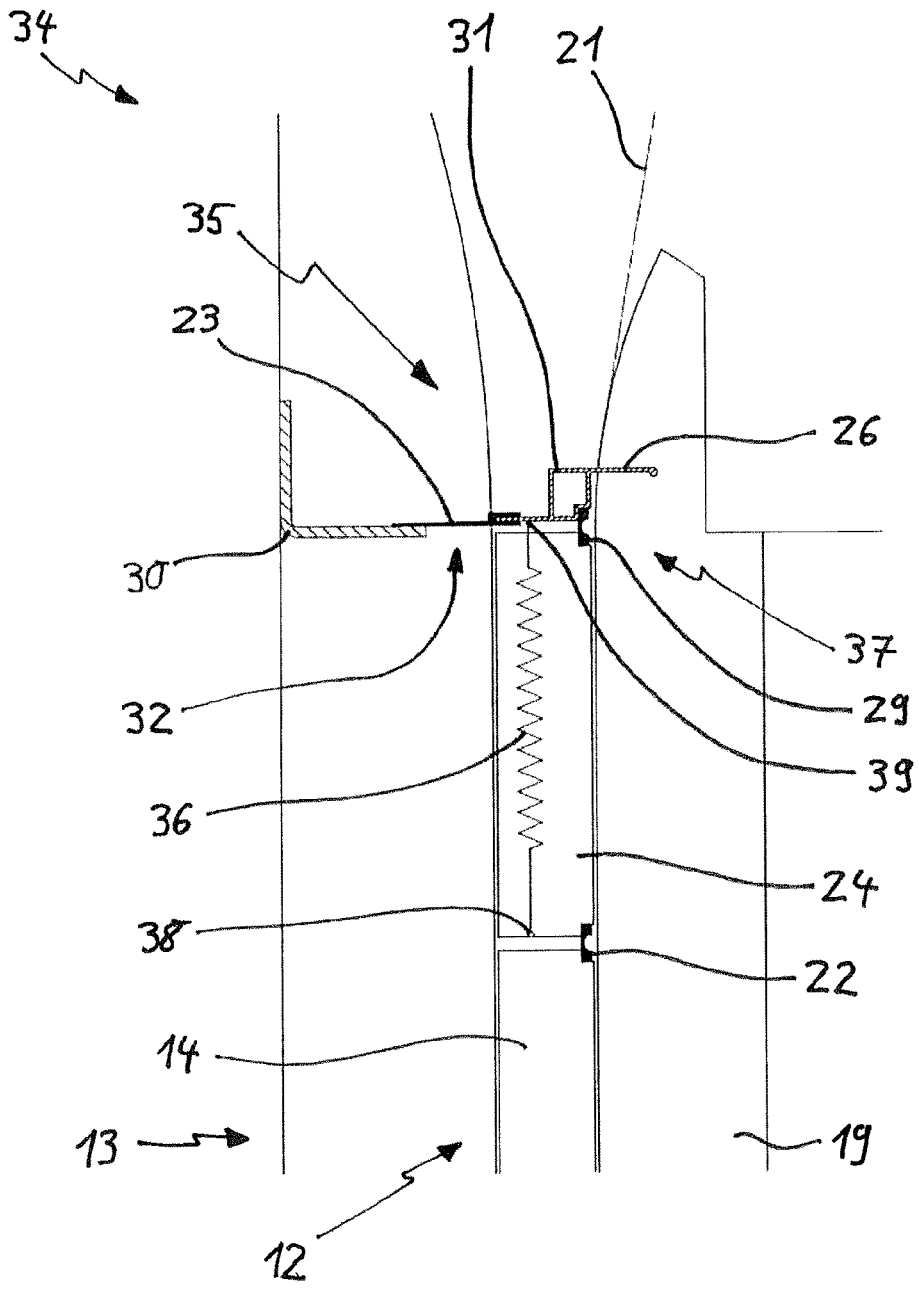
FIG. 8 is a schematic cross sectional side view of a detail a second roller shutter with a sealing device according to the present invention having a first actuating element.

FIG. 8 is a schematic cross sectional side view of a detail of a second roller shutter 34 with a sealing device 35 according to the present invention having a first actuating element 36. As far as identical elements are concerned reference is made to the above mentioned description.

The sealing device 35 has a swivel mechanism 37 that comprises all elements of the swivel mechanism 25 according to FIGS. 1 to 7. Additionally the swivel mechanism 37 has an actuating element 36. The actuating element 36 is designed to force the sealing device 35 or sealing means 23 from the winding position into the sealing position when the door blade 12 is completely unrolled or closed.

In this embodiment the actuating element 36 is a spring, namely a tension spring. The actuating element 36 is arranged within the top lamella 24. A first end 38 of the actuating element 36 directed away from the sealing device 35 or sealing means 23 is fixed to the top lamella 24. A second end 39 of the actuating element 36 directed away from the first end 38 is connected with sealing means 23 or base profile 31. The second end 39 is fixed to the sealing means 23 or the base profile 31 in an area spaced apart from the swivel axis of the hinge 29. In this embodiment the second end 29 of the actuating element 36 acts on the sealing device 35 or sealing means 23 in an area between the swivel axis of the hinge 29 and an outer free end of the sealing means 23. Thus, the sealing device 35 and the sealing means 23 is forced into the sealing position to cover gap 32 when the first swivel element 26 is not forced into its winding position by the further swivel element 27.

The actuating element 36 may be provided on the left hand side and on the right hand side of the roller shutter 34, whereby each actuating element 36 is capable of forcing the sealing device 35 or sealing means 23 into the sealing position. Thus, providing two or more actuating elements 36 establish a redundant actuating system.

Figure 9:
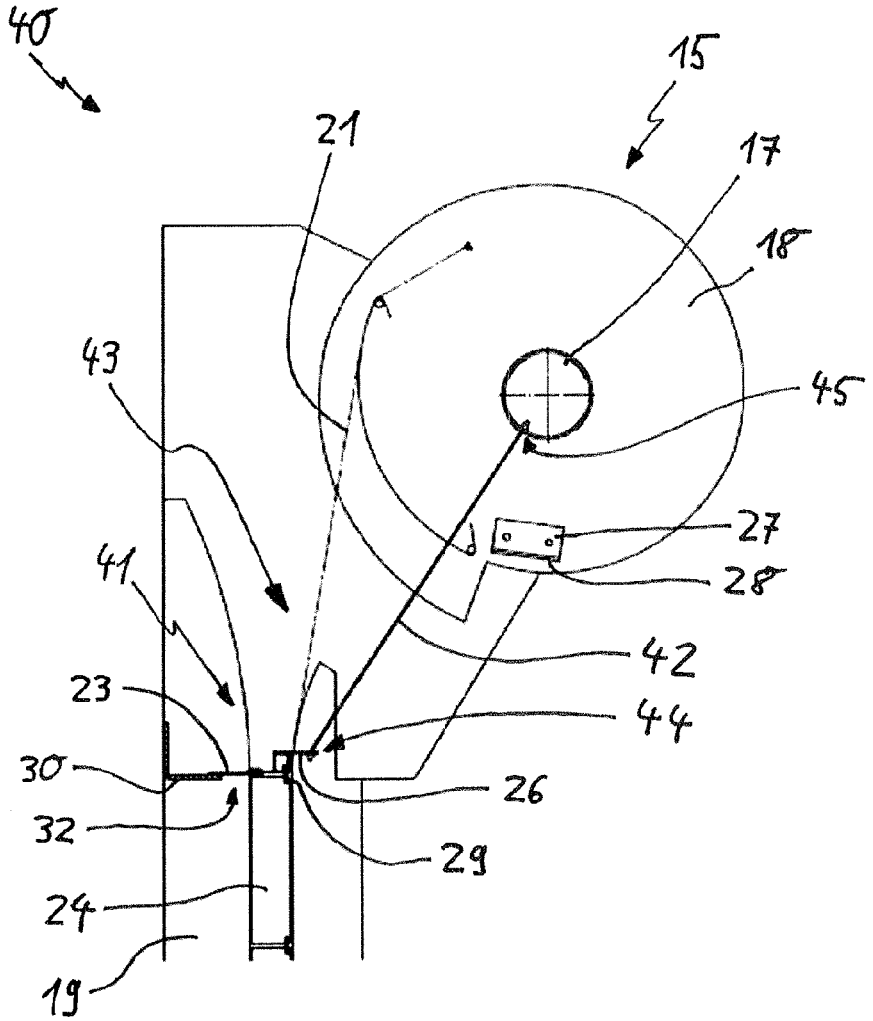
FIG. 9 is a schematic cross sectional side view of a detail a further roller shutter with a sealing device according to the present invention in a sealing position having a further actuating element.

FIG. 9 is a schematic cross sectional side view of a detail of a further roller shutter 40 with a sealing device 41 according to the present invention in a sealing position having a further actuating element 42. As far as identical elements are concerned reference is made to the above mentioned description.

The sealing device 41 has a swivel mechanism 43 that comprises all elements of the swivel mechanism 25 according to FIGS. 1 to 7. Additionally the swivel mechanism 41 has an actuating element 42. The actuating element 42 is designed to force the sealing device 41 from the winding position into the sealing position when the door blade 12 is completely unrolled or closed.

In this embodiment the actuating element 42 is a flexible cable. The actuating element 42 is connecting the rotatable shaft 17 of the coiling device 15 with the first swivel element 26. A first end 44 of the actuating element 42 is fixed at the first swivel element 26. The first end 44 is displaced from a contact area of the first swivel element 26 for cooperating with the further swivel element 27 such that an entanglement of the actuating element 42 with the further swivel element 27 is avoided. A second end 45 of the actuating element 42 directed away from the first end 44 is non-rotatably mounted to the rotatable shaft 17. Thus, the second end 45 is turned together with the rotatable shaft 17 when the coiling device 15 is in rotation for up rolling or unrolling the door blade 12. The length of the flexible actuating element 42 is such that the sealing device 41 and the sealing means 23 is forced into the sealing position for sealing the gap 32 when the door blade 12 is completely unrolled from the coiling device 15 to close the doorway 13. Thus, the sealing device 41 and the sealing means 23 is forced into the sealing position to cover gap 32 when the first swivel element 26 is not forced into the winding position by the further swivel element 27 and when the top lamella 24 is in its lowest position within the roller shutter 40 or the side rails 19. In this position of the top lamella 24 the actuating element 42 is under tension.

In an alternative embodiment the first end 44 of the actuating element 42 is not fixed at the first swivel element 26 but at a separate mounting. The mounting may be fixed to upper end of the top lamella 24 and/or the first swivel element 26. Furthermore, the mounting may be designed as a rigid arm and may be fixed to the base profile 31. Preferably the mounting is designed and arranged substantially like the first swivel element 26. The mounting may be swivelled around the swivel axis of the hinge 29 from a sealing position to a winding position and vice versa like the first swivel element 26.

The actuating element 42 may be provided on the left hand side and on the right hand side of the roller shutter 40, whereby each actuating element 42 is capable of forcing the sealing device 41 or sealing means 23 into the sealing position. Thus, providing two or more actuating elements 42 establish a redundant actuating system.

The actuating elements 36 and 42 according to FIGS. 8 and 9 may be used as alternatives or in combination, preferably for providing a redundant actuating system.

Figure 10:
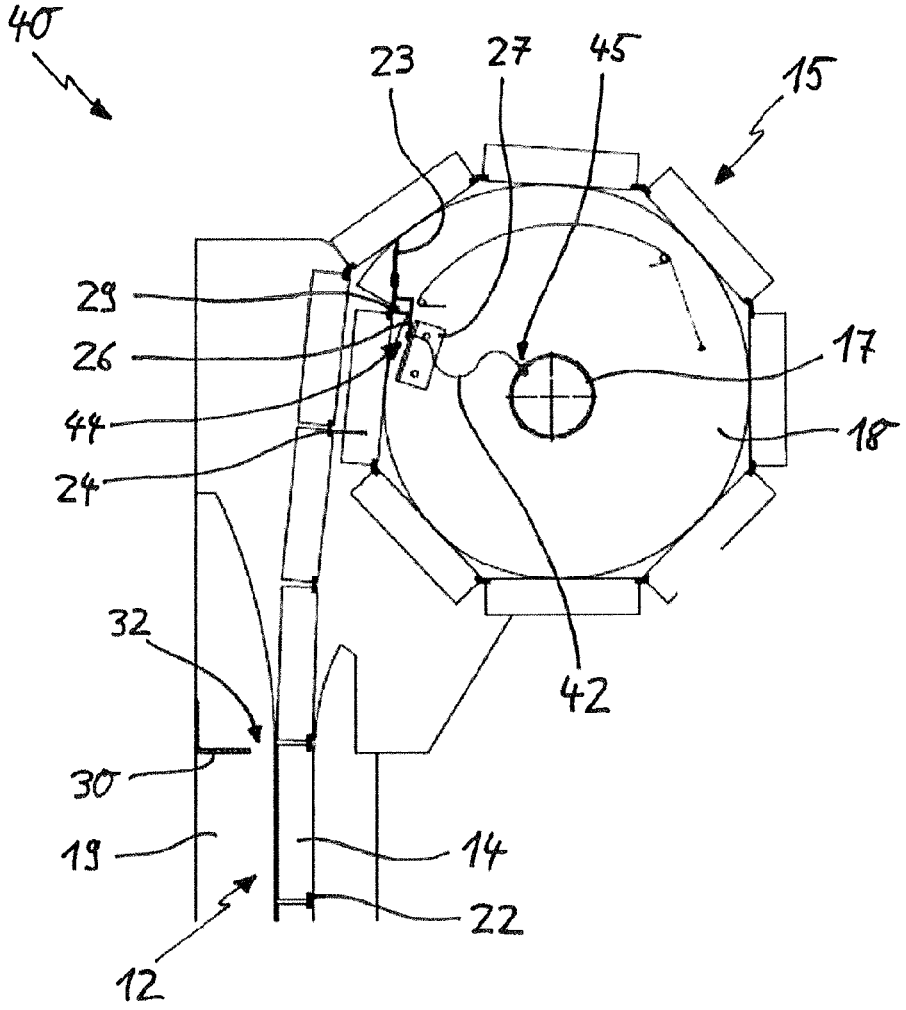
FIG. 10 is a schematic cross sectional side view of a detail of the further roller shutter according to FIG. 9 with the sealing device in a winding position.

FIG. 10 is a schematic cross sectional side view of a detail of the further roller shutter 40 according to FIG. 9 with the sealing device 41 and sealing means 23 in a winding position.

The upper lamellae 14 establish a first layer of lamellae 14 or end pieces 20 on the outer circumference of the coiling device 15. The doorway 13 is partly closed or opened and the lamellae 14, 24, guided by a slit 33 in the side rail 19, run into or out of the side rail 19.

In the winding position of the sealing device 41 or sealing means 23 the first swivel element 26 and the further swivel element 27 cooperate with each other to hold the sealing means 23 in a position which is substantially swivelled about 90 degree around the swivel axis of the hinge 29. In the winding position the sealing means 23 is aligned substantially parallel to the plane of the top lamella 24.

When the door blade 12 and the top lamella 24 is moved from an unrolled position in which the sealing device 41 or sealing means 23 is in the sealing position according to FIG. 9 upwards or towards the coiling device 15 the flexible actuating element 42 gets relaxed or untensioned. This allows the further swivel element 27 to force the first swivel element 26 together with the sealing means 23 into the winding position.

Although preferred embodiments of the present invention and modifications thereof have been described in detail herein, it is to be understood that this invention is not limited to these precise embodiments and variations and may be effected by one skilled in the art without departing from the spirit and scope of the invention as defined by the appended claims.

The use of expressions like "particularly", "preferably", "more preferably" or "especially preferred" etc. is not intended to limit the invention. Features which are not specifically or explicitly described or claimed may be additionally included in the structure or method according to the present invention without deviating from its scope.

REFERENCE NUMERALS

10 roller shutter
11 sealing device
12 door blade
13 doorway
14 shutter element
15 coiling device
16 drive
17 shaft
18 spiral disc
19 side rail
20 end section/end piece
21 carrying strap
22 seal
23 sealing means
24 top shutter element
25 swivel mechanism
26 first swivel element
27 further swivel element
28 surface
29 hinge
30 lintel
31 base profile
32 gap
33 slit
34 roller shutter
35 sealing device
36 actuating element
37 swivel mechanism
38 first end
39 second end
40 roller shutter
41 sealing device
42 actuating element
43 swivel mechanism
44 first end
45 second end

I claim:

1. A sealing device for sealing a gap between a lintel and a roller shutter, the sealing device comprising:

a sealing means at an upper end of a top shutter element of the roller shutter;

a swivel mechanism arranged to swivel the sealing means from a sealing position into a winding position and from the winding position into the sealing position, wherein the swivel mechanism comprises a first swivel element for swiveling the sealing means from the sealing position into the winding position; and a swivel axis, wherein the first swivel element and the sealing means are positioned to rotate opposite one another with respect to the swivel axis;

wherein the first swivel element and the sealing means rotate about the swivel axis to swivel the sealing means from the sealing position to the winding position, such that the first swivel element is moved towards the top shutter element and the sealing means is moved away from the shutter element;

wherein the roller shutter comprises a coiling device and wherein the swivel mechanism comprises a further swivel element fixed to the coiling device to rotate the first swivel element and sealing means about the swivel axis into the winding position.

2. The sealing device according to claim 1, wherein the swivel axis comprises a hinge having a flexible rubber profile connecting the sealing means with the upper end of the top shutter element.

3. The sealing device according to claim 1, wherein the sealing means extends traverse to or perpendicular to a plane of the roller shutter when the roller shutter is in a closed position; and wherein the sealing means comprises a flexible sealing profile, a flexible sealing lip or an at least partly flexible sealing flap having a tubular cross-section.

4. The sealing device according to claim 1, wherein the first swivel element extends traverse to or perpendicular to a plane of the roller shutter when the roller shutter is in a closed position; and wherein the first swivel element is a rigid arm, bar, or projection.

5. The sealing device according to claim 4, wherein the first swivel element and the sealing means are arranged in the same plane; and wherein the sealing means rotates about the swivel axis downward to swing into the sealing position and wherein the first swivel element rotates about the swivel axis upward to swing the sealing means into the sealing position.

6. The sealing device according to claim 4, wherein the coiling device comprises a spiral shaped portion for coiling the shutter elements and wherein the further swivel element is fixed to the coiling device in an area of a smallest radius of the spiral shaped portion of the coiling device; and wherein the first swivel element or the further swivel element comprises one or more of a low friction material, a wear-resistant material, and a plastic.

7. The sealing device according to claim 1, wherein the sealing means and first swivel element have a center of gravity and wherein the center of gravity is located on the same side of the swivel axis as the sealing means for allowing the sealing means to rotate about the swivel axis from the winding position into the sealing position under the effect of gravity.

8. The sealing device according to claim 1, wherein the swivel mechanism further comprises at least one actuating element connected with the sealing means or the first swivel element, wherein the actuating element applies a force to swivel the sealing means from the winding position into the sealing position;

wherein the actuating element comprises one or more of a spring, a flexible cable, a flexible rod, and a flexible cord.

9. The roller shutter according to claim 1 adapted for opening and closing a doorway, further comprising:

a door blade, the door blade comprising:

a plurality of rigid shutter elements which are hinged with each other, wherein the top shutter element comprises one of the rigid shutter elements, and wherein the rigid shutter elements are guided by side rails at opposed sides of the doorway.

10. The roller shutter according to claim 9, wherein the door blade is configured to be in a completely unrolled position when the sealing means of the sealing device is in the sealing position; and wherein the door blade is configured to be in an at least partly up rolled position when the sealing means of the sealing device is in the winding position.

11. The roller shutter according to claim 9, wherein the sealing means and the first swivel element extend traverse to or perpendicular to a plane of the top shutter element when the door blade is in a closed position; and wherein the sealing means and the first swivel element extend parallel to the plane of the top shutter element when the door blade is in an up rolled position.

12. The roller shutter according to claim 9, wherein the sealing device is a retrofit kit; and wherein one or more of the swivel mechanism, the first swivel element, a second swivel element, and an actuating element are arranged on a left hand side or right hand side of the roller shutter.

13. The roller shutter according to claim 9, wherein the side rails each comprise a slit;

wherein end pieces of the shutter elements are arranged inside the slits of the side rails, the slits guiding the shutter elements for opening and closing the doorway; and wherein the door blade further comprises a carrying strap connected with the end pieces and with a coiling device to roll up and roll down the shutter elements.

14. The roller shutter according to claim 9, further comprising:

a coiling device comprising a plurality of spiral discs;

wherein at least one of the spiral discs is arranged proximate to each end of a rotatable shaft;

wherein each of the spiral discs is shaped for receiving respective end sections of the shutter elements rolled up on the coiling device; and wherein the spiral discs are spaced apart along the shaft a distance for receiving the end sections.

15. The roller shutter according to claim 9, wherein the shutter elements are formed as lamellae, slats or panels, wherein the shutter elements are connected with each other by flexible joints or a flexible carrying strap for rolling up and unrolling the door blade on and off a coiling device.

16. The roller shutter according to claim 9, wherein the roller shutter is a high speed roller door, and wherein the door blade is configured to be moved with a speed in the range of 0.5 m/s to 5 m/s.

17. The roller shutter according to claim 16, wherein the door blade is configured to be moved with a speed in the range of 1 m/s to 3 m/s.

18. The roller shutter according to claim 15, wherein the shutter elements comprise foamed lamellae.

19. The sealing device according to claim 2, wherein the sealing means extends perpendicular to a plane of the roller shutter when the roller shutter is in a closed position; and wherein the sealing means comprises a flexible sealing profile, a flexible sealing lip or an at least partly flexible sealing flap, having a tubular cross-section.

20. The sealing device according to claim 5, wherein the further swivel element is fixed to the coiling device in an area of a smallest radius of the coiling device; and wherein the first swivel element or the further swivel element comprise one or more of a low friction material, a wear-resistant material, and a plastic.

* * * * *